US009261265B1

(12) United States Patent
Yan et al.

(10) Patent No.: US 9,261,265 B1
(45) Date of Patent: Feb. 16, 2016

(54) BACKLIGHT DISPLAY DEVICE

(71) Applicant: E Ink Holdings Inc., Hsinchu (TW)

(72) Inventors: Shu-Ping Yan, Hsinchu (TW); Pei-Lin Huang, Hsinchu (TW); Wei-Chou Lan, Hsinchu (TW); Chia-Chun Yeh, Hsinchu (TW)

(73) Assignee: E Ink Holdings Inc., Hsinchu (TW)

( * ) Notice: Subject to any disclaimer, the term of this patent is extended or adjusted under 35 U.S.C. 154(b) by 0 days.

(21) Appl. No.: 14/724,831

(22) Filed: May 29, 2015

(30) Foreign Application Priority Data

Jul. 30, 2014 (TW) ..... 103126038 A

(51) Int. Cl.

| | |
|---|---|
| ***G09G 3/10*** | (2006.01) |
| ***F21V 23/00*** | (2015.01) |
| ***H05B 33/12*** | (2006.01) |
| ***F21S 8/00*** | (2006.01) |
| *F21Y 105/00* | (2006.01) |

(52) U.S. Cl.
CPC ..... *F21V 23/005* (2013.01); *F21S 8/033* (2013.01); *H05B 33/12* (2013.01); *F21Y 2105/001* (2013.01)

(58) Field of Classification Search
None
See application file for complete search history.

(56) References Cited

U.S. PATENT DOCUMENTS

| | | | | |
|---|---|---|---|---|
| 7,382,384 | B2 | 6/2008 | Winters et al. | |
| 8,379,003 | B2 | 2/2013 | Kawaguchi et al. | |
| 2006/0061524 | A1 | 3/2006 | Suh et al. | |
| 2009/0058776 | A1 | 3/2009 | Tomohiro et al. | |
| 2009/0128527 | A1 | 5/2009 | Itakura et al. | |
| 2009/0147164 | A1 | 6/2009 | Toyoshima et al. | |
| 2011/0074749 | A1* | 3/2011 | Higashi | 345/206 |
| 2011/0128468 | A1* | 6/2011 | Koganezawa | 349/61 |
| 2011/0227893 | A1 | 9/2011 | Bae et al. | |
| 2012/0075268 | A1 | 3/2012 | Chung et al. | |
| 2013/0249877 | A1* | 9/2013 | Choi et al. | 345/205 |

FOREIGN PATENT DOCUMENTS

| | | | |
|---|---|---|---|
| CN | 102483888 | A | 5/2012 |
| JP | H08234683 | A | 9/1996 |
| TW | 200809712 | A | 2/2008 |
| TW | I388198 | B | 3/2013 |
| TW | 201314311 | A | 4/2013 |
| TW | 201426995 | A | 7/2014 |

OTHER PUBLICATIONS

Corresponding Taiwanese Office Action that these art references were cited on Jun. 16, 2015.

* cited by examiner

*Primary Examiner* — Anh Tran
(74) *Attorney, Agent, or Firm* — CKC & Partners Co., Ltd.

(57) ABSTRACT

A backlight display device includes a pixel region, a light-emitting region, a control element, a plurality of first flexible printed circuit board (FPCB) contacts, and a plurality of first driving circuits. The pixel region has a first edge, a second edge opposite to the first edge, a third edge, and a fourth edge opposite to the third edge. A corner region is formed between the first edge and the fourth edge. The light-emitting region is located on the corner region of the pixel region. The control element is located on the corner region of the pixel region and between the light-emitting region and the first edge. The first FPCB contacts are located on the second edge. Each of the first driving circuits is electrically connected to one of the first FPCB contacts and the control element.

12 Claims, 3 Drawing Sheets

BACKLIGHT DISPLAY DEVICE

RELATED APPLICATIONS

This application claims priority to Taiwanese Application Serial Number 103126038, filed Jul. 30, 2014, which is herein incorporated by reference.

BACKGROUND

1. Field of Invention

The present invention relates to a backlight display device.

2. Description of Related Art

In general, when there is a requirement for displaying an image with large area, plural display devices may be closely arranged to form an assembling display wall with large area, such as a TV wall with large area.

Each of the display devices has plural driving circuits, a display region, and an edge frame. The display region is composed of plural pixel regions, and the driving circuits are located outside of the display region and electrically connected to the pixel regions. The display region is exposed through the display opening of the edge frame, and the edge frame covers and accommodates the driving circuits.

However, since the edge frame outside of the display region needs to cover and accommodate the driving circuits, gaps between adjacent images are formed due to the edge frames of the display devices when the display devices are closely connected. As a result, the images of the display devices are discontinuous, and thereby downgrading visual effect when users watch the display wall.

SUMMARY

An aspect of the present invention is to provide a backlight display device for assembling a display wall.

According to an embodiment of the present invention, a backlight display device includes a pixel region, a light-emitting region, a control element, a plurality of first flexible printed circuit board (FPCB) contacts, and a plurality of first driving circuits. The pixel region has a first edge, a second edge opposite to the first edge, a third edge, and a fourth edge opposite to the third edge. A corner region is formed between the first edge and the fourth edge. The ht-emitting region is located on the corner region of the pixel region. The control element is located on the corner region of the pixel region and between the light-emitting region and the first edge. The first FPCB contacts are located on the second edge. Each of the first driving circuits is electrically connected to one of the first FPCB contacts and the control element.

In one embodiment of the present invention, the light-emitting region includes a plurality of positive contacts, a plurality of negative contacts, and a plurality of light-emitting diodes. Each of the light-emitting diodes is electrically connected to one of the positive contacts and one of the negative contacts.

In one embodiment of the present invention, the backlight display device further includes a second FPCB contact and a second driving circuit. The second FPCB contact is located on the third edge of the pixel region. The second driving circuit is electrically connected to the positive contacts and the second FPCB contact.

In one embodiment of the present invention, the backlight display device further includes a third FPCB contact and a third driving circuit. The third FPCB contact is located on the third edge of the pixel region. The third driving circuit is electrically connected to the negative contacts and the third flexible printed circuit board contact.

In one embodiment of the present invention, the positive contacts are parallel to the control element.

In one embodiment of the present invention, the negative contacts are parallel to the control element.

In one embodiment of the present invention, a first spacing is formed between the control element and the first edge of the pixel region.

In one embodiment of the present invention, a distance between the second edge of the pixel region and the light-emitting region is greater than the first spacing.

In one embodiment of the present invention, a second spacing is formed between the control element and the fourth edge of the pixel region.

In one embodiment of the present invention, the backlight display device has a side edge. The second edge of the pixel region overlaps the side edge of the backlight display device.

In one embodiment of the present invention, the control element is a thin-film transistor.

In one embodiment of the present invention, the light-emitting region is adjacent to the control element.

In the aforementioned embodiments of the present invention, the light-emitting region and the control element are located on the corner region of the pixel region, the first FPCB contacts are located on the second edge of the pixel region, and each of the first driving circuits is electrically connected to one of the first FPCB contacts and the control element. Therefore, the light-emitting region, the control element, the first FPCB contacts, and the first driving circuits are located in the pixel region. When the backlight display device is used in an assembling display wall, a conventional edge frame for covering and accommodating conventional driving circuits and the conventional driving circuits in the edge frame can be omitted. As a result, in the assembling display wall formed by the backlight display devices of the present invention that are closely connected, the connections of the images of every two adjacent backlight display devices are continuous, and thereby achieving the purpose of seamless connection and significantly improving visual effect of the display wall.

It is to be understood that both the foregoing general description and the following detailed description are by examples, and are intended to provide further explanation of the invention as claimed.

BRIEF DESCRIPTION OF THE DRAWINGS

The invention can be more fully understood by reading the following detailed description of the embodiments, with reference made to the accompanying drawings as follows.

DETAILED DESCRIPTION

Figure 1:
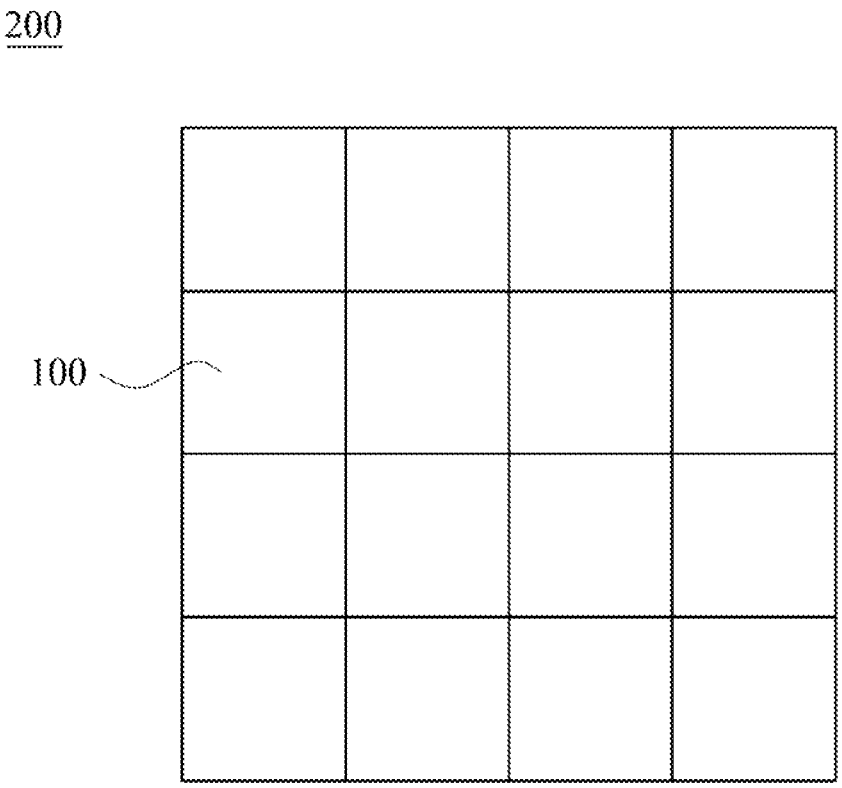
FIG. 1 is a front view of a display wall formed by connected backlight display devices according to one embodiment of the present invention.

Reference will now be made in detail to the present embodiments of the invention, examples of which are illustrated in the accompanying drawings. Wherever possible, the same reference numbers are used in the drawings and the description to refer to the same or like parts.

FIG. 1 is a front view of a display wall 200 formed by connected backlight display devices 100 according to one embodiment of the present invention. As shown in FIG. 1, the display wall 200 includes plural display devices 100. The display devices 100 are closely connected to assemble the display wall 200, such that the display wall 200 can display an image with an area that is greater than the area of the image of a single display device 100. In this embodiment, the display device 100 does not have a conventional edge frame for covering and accommodating conventional driving circuits. As a result, when the display wall 200 displays an image, the connections of the images of every two adjacent backlight display devices 100 are continuous, so that the visual effect of the display wall 200 is significantly improved.

The number of the backlight display devices 100 in the display wall 200 may be varied as deemed necessary by designers. In the following description, inner elements of the backlight display devices 100 will be described.

Figure 2:
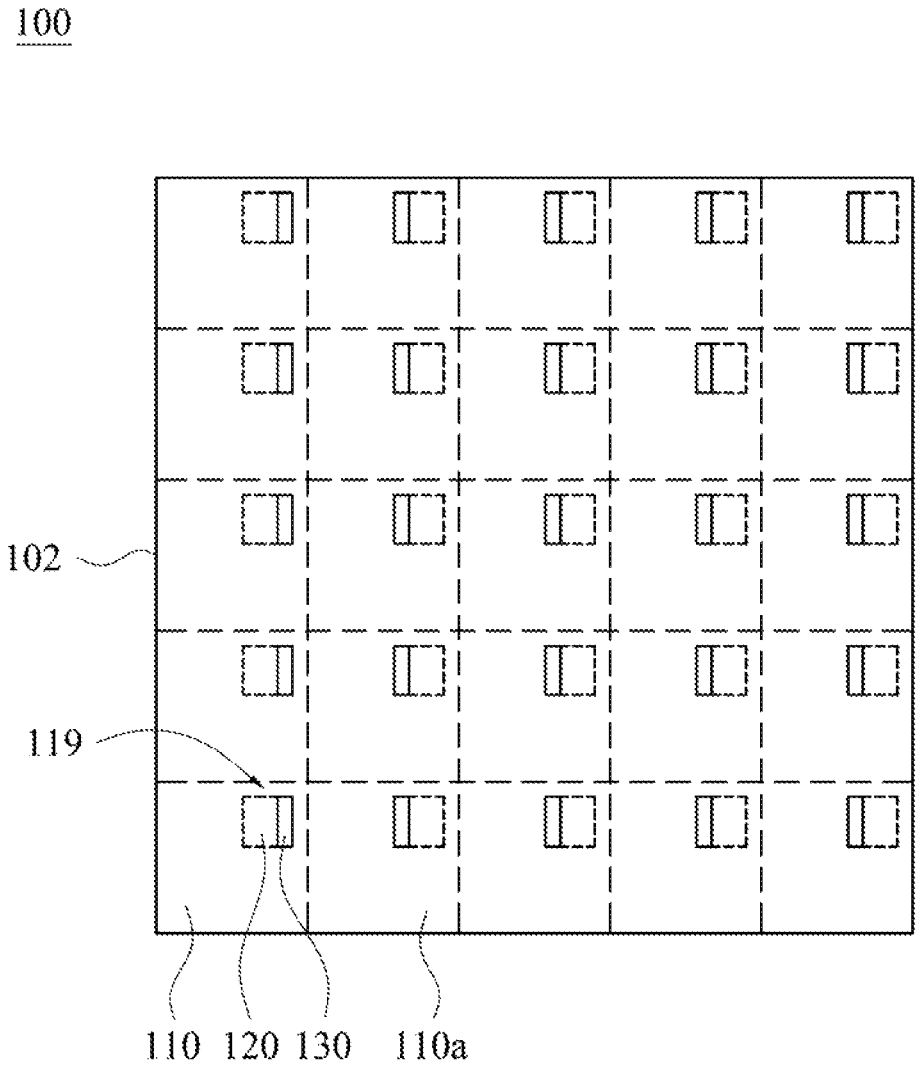
FIG. 2 is an enlarged view of the backlight display device shown in FIG. 1.

FIG. 2 is an enlarged view of the backlight display device 100 shown in FIG. 1. As shown in FIG. 2, the backlight display device 100 includes plural pixel regions 110, 110*a*, a light-emitting region 120, and a control element 130. A region formed by the pixel regions 110, 110*a* may be regarded as the display region of the backlight display device 100. The backlight display device 100 has a side edge 102. The difference between the pixel regions 110, 110*a* is that the pixel regions 110 are adjacent to the side edge 102 of the backlight display device 100, and the pixel regions 110*a* are adjacent to the pixel regions 110 or other pixel regions 110*a*. That is to say, the pixel regions 110*a* are located on the display region except the pixel regions 110, and not adjacent to the side edge 102. In this embodiment, the number of the pixel regions 110 is five, and the number of the pixel regions 110*a* is twenty, but the present invention is not limited in this regard.

Moreover, the arrangement of the light-emitting region 120 and the control element 130 in the pixel region 110 and that of the light-emitting region 120 and the control element 130 in the pixel region 110*a* are in a reverse direction. The light-emitting region 120 and the control element 130 in the pixel region 110 are mirror reflectively disposed to the light-emitting region 120 and the control element 130 in the pixel region 110*a*. The driving circuits (to be described hereinafter) of the backlight display devices 100 extends from the pixel regions 110 that is adjacent to the side edge 102 to the pixel regions 110*a*, and the driving circuits of the backlight display devices 100 may replace conventional driving circuits disposed outside of the side edge of a conventional backlight display device. In the following description, the configuration of elements in one of the pixel regions 110 will be described.

Figure 3:
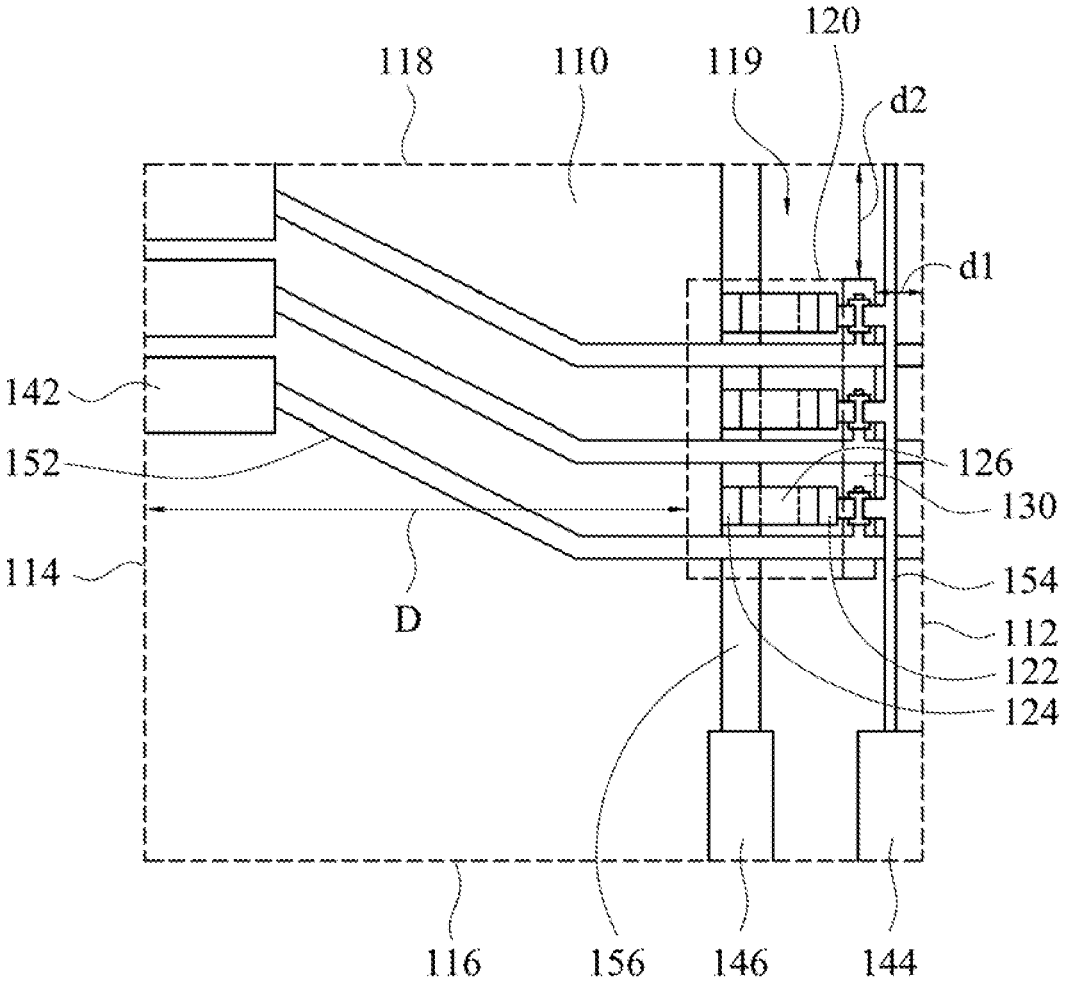
FIG. 3 is an enlarged view of a pixel region, a light-emitting region, and a control element shown in FIG. 2.

FIG. 3 is an enlarged view of the pixel region 110, the light-emitting region 120, and the control element 130 shown in FIG. 2. As shown in FIG. 2 and FIG. 3, the backlight display device 100 includes plural first flexible printed circuit board (FPCB) contacts 142, and plural first driving circuits 152. The pixel region 110 has a first edge 112, a second edge 114 that is opposite to the first edge 112, a third edge 116, and a fourth edge 118 that is opposite to the third edge 116. A corner region 119 is formed between the first edge 112 and the fourth edge 118. The first, second, third, and fourth edges 112, 114, 116, 118 surround the pixel region 110.

The light-emitting region 120 and the control element 130 are located on the corner region 119 of the pixel region 110, and the control element 130 is between the light-emitting region 120 and the first edge 112 of the pixel region 110. The first. FPCB contacts 142 are located on the second edge 114 of the pixel region 110. Each of the first driving circuits 152 is electrically connected to one of the first FPCB contacts 142 and the control element 130.

The light-emitting region 120 and the control element 130 are located on the corner region 119 of the pixel region 110, the first FPCB contacts 142 are located on the second edge 114 of the pixel region 110, and each of the first driving circuits 152 is electrically connected to one of the first FPCB contacts 142 and the control element 130. Therefore, the light-emitting region 120, the control element 130, the first FPCB contacts 142, and the first driving circuits 152 are located in the pixel region 110. When the backlight display device 100 is used in the assembling display wall 200 (see FIG. 1), a conventional edge frame for covering and accommodating conventional driving circuits and the conventional driving circuits in the edge frame can be omitted. As a result, in the assembling display wall 200 formed by the backlight display devices 100 of the present invention that are closely connected, the connections of the images of every two adjacent backlight display devices 100 are continuous, and thereby achieving the purpose of seamless connection and significantly improving visual effect of the display wall 200.

In addition, since the light-emitting region 120 and the control element 130 are located on the corner region 119 of the pixel region 110 and the first. FPCB contacts 142 are located on the second edge 114 of the pixel region 110, the line length of the first driving circuit 152 may be extended. As a result, the stability of signal transmissions between the first FPCB contacts 142 and the control element 130 may be improved.

In this embodiment, the light-emitting region 120 includes plural positive contacts 122, plural negative contacts 124, and plural light-emitting diodes 126. The positive contacts 122 are parallel to the control element 130, and the negative contacts 124 are parallel to the control element 130. Furthermore, each of the light-emitting diodes 126 is electrically connected to one of the positive contacts 122 and one of the negative contacts 124. The backlight display device 100 may further include a second FPCB contact 144, a second driving circuit 154, a third FPCB contact 146, and a third driving circuit 156. The second and third FPCB contacts 144, 146 are located on the third edge 116 of the pixel region 110. The second driving circuit 154 is electrically connected to the positive contacts 122 and the second FPCB contact 144, and the third driving circuit 156 is electrically connected to the negative contacts 124 and the third FPCB contact 146.

When the pixel region 110 is in operation, the first, second, and third FPCB contacts 142, 144, 146 may transmit signals and electricity by respectively utilizing the first, second, and third driving circuits 152, 154, 156, and the light-emitting diodes 126 of the light-emitting region 120 are controlled to emit light by the control element 130. In this embodiment, the control element 130 may be a thin-film transistor, but the present invention is not limited in this regard. In addition, the light-emitting region 120 is adjacent to the control element 130, such that the line layout in the pixel region 110 is uncomplicated.

The second edge 114 of the pixel region 110 overlaps the side edge 102 of the backlight display device 100, and the first, second, and third driving circuits 152, 154, 156 are located in the pixel region 110, such that the backlight display device 100 can omit a conventional edge frame and conventional driving circuits in the edge frame. As a result, the entire area of the backlight display device 100 is a display region, and may emit light by the pixel regions 110, 110*a*.

In addition, when the backlight display device 100 is manufactured, the backlight display device 100 may be a portion of a mother substrate that is not yet cut to form plural backlight display devices 100. When the mother substrate is cut by a knife, the light-emitting region 120 and the control element 130 of one of the backlight display devices 100 that is adjacent to the side edge 102 of another backlight display device 100 may be damaged. Therefore, in order to prevent the aforesaid situation, a first spacing d1 is designed to form between the control element 130 and the first edge 112 of the pixel region 110, and a second spacing d2 is designed to form between the control element 130 and the fourth edge 118 of the pixel region 110 in this embodiment. That is to say, the first spacing d1 and second spacing d2 may be buffer regions when cutting the mother substrate.

In this embodiment, a distance D between the second edge 114 of the pixel region 110 and the light-emitting region 120 is greater than the first spacing d1, such that the light-emitting region 120 and the control element 130 are located on a side of the pixel region 110 facing away from the second edge 114 of the pixel region 110, and the light-emitting region 120 and the control element 130 are adjacent to the first edge 112 of the pixel region 110.

Although the present invention has been described in considerable detail with reference to certain embodiments thereof, other embodiments are possible. Therefore, the spirit and scope of the appended claims should not be limited to the description of the embodiments contained herein.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims.

What is claimed is:

1. A backlight display device for assembling a display wall, wherein the backlight display device comprises:

a pixel region having a first edge, a second edge opposite to the first edge, a third edge, and a fourth edge opposite to the third edge, wherein a corner region is formed between the first edge and the fourth edge;

a light-emitting region located on the corner region of the pixel region;

a control element located on the corner region of the pixel region and between the light-emitting region and the first edge;

a plurality of first flexible printed circuit board contacts located on the second edge; and a plurality of first driving circuits, wherein each of the first driving circuits is electrically connected to one of the first flexible printed circuit board contacts and the control element.

2. The backlight display device of claim 1, wherein the light-emitting region comprises:

a plurality of positive contacts;

a plurality of negative contacts; and a plurality of light-emitting diodes, wherein each of the light-emitting diodes is electrically connected to one of the positive contacts and one of the negative contacts.

3. The backlight display device of claim 2, further comprising:

a second flexible printed circuit board contact located on the third edge of the pixel region; and a second driving circuit electrically connected to the positive contacts and the second flexible printed circuit board contact.

4. The backlight display device of claim 2, further comprising:

a third flexible printed circuit board contact located on the third edge of the pixel region; and a third driving circuit electrically connected to the negative contacts and the third flexible printed circuit board contact.

5. The backlight display device of claim 2, wherein the positive contacts are parallel to the control element.

6. The backlight display device of claim 2, wherein the negative contacts are parallel to the control element.

7. The backlight display device of claim 1, wherein a first spacing is formed between the control element and the first edge of the pixel region.

8. The backlight display device of claim 7, wherein a distance between the second edge of the pixel region and the light-emitting region is greater than the first spacing.

9. The backlight display device of claim 1, wherein a second spacing is formed between the control element and the fourth edge of the pixel region.

10. The backlight display device of claim 1, having a side edge, wherein the second edge of the pixel region overlaps the side edge of the backlight display device.

11. The backlight display device of claim 1, wherein the control element is a thin-film transistor.

12. The backlight display device of claim 1, wherein the light-emitting region is adjacent to the control element.

* * * * *